US007604114B2

(12) United States Patent
Gessler

(10) Patent No.: US 7,604,114 B2
(45) Date of Patent: Oct. 20, 2009

(54) PACKAGE ASSEMBLY

(75) Inventor: Richard J. Gessler, Stillwater, MN (US)

(73) Assignee: Delkor Systems, Inc., Circle Pines, MN (US)

( * ) Notice: Subject to any disclaimer, the term of this patent is extended or adjusted under 35 U.S.C. 154(b) by 0 days.

(21) Appl. No.: 12/032,951

(22) Filed: Feb. 18, 2008

(65) Prior Publication Data

US 2008/0223909 A1 Sep. 18, 2008

Related U.S. Application Data

(63) Continuation-in-part of application No. 10/668,646, filed on Sep. 23, 2003, now Pat. No. 7,370,761, which is a continuation-in-part of application No. 10/388,100, filed on Mar. 13, 2003, now abandoned, which is a continuation of application No. 09/902,971, filed on Jul. 11, 2001, now Pat. No. 6,588,594.

(51) Int. Cl.
*B65D 75/00* (2006.01)

(52) U.S. Cl. ..... 206/144; 206/497

(58) Field of Classification Search ..... 206/142–144, 206/427, 429, 431, 432, 434, 497
See application file for complete search history.

(56) References Cited

U.S. PATENT DOCUMENTS 3,018,919 A * 1/1962 Pelt ..... 206/144
4,119,202 A * 10/1978 Roth ..... 206/432
4,286,709 A * 9/1981 Manizza ..... 206/144
4,606,457 A * 8/1986 Pugh ..... 206/427
4,635,795 A 1/1987 DeFlander et al.
5,337,950 A 8/1994 Bower
5,375,715 A * 12/1994 Serre et al. ..... 206/427
5,520,325 A * 5/1996 Quaintance ..... 229/120.26
5,657,872 A 8/1997 Leftwich et al.
5,813,540 A 9/1998 Vollbrecht et al.
5,887,717 A * 3/1999 Anderson et al. ..... 206/497
6,182,422 B1 2/2001 Andersen et al.
6,499,596 B1 12/2002 Andersen et al.
6,588,594 B2 7/2003 Andersen et al.
7,066,379 B2 6/2006 McLeod et al.
2004/0129594 A1 7/2004 Andersen et al.
2007/0068121 A1 3/2007 Mate et al.

* cited by examiner

*Primary Examiner*—Luan K Bui
(74) *Attorney, Agent, or Firm*—Vidas, Arrett & Steinkraus, P.A.

(57) ABSTRACT

A container package assembly includes two support members. Both the support members have a top, a bottom, a first side, a second side, and a vertical support. For each support member, the vertical support is integrally engaged to the top, the bottom, the first side, and the second side. For each support member, the top is substantially parallel to the bottom, the first side is substantially parallel to the second side, and the vertical support is substantially perpendicular to the top and the bottom. For each support member, the first side and the second side have a top edge and a bottom edge, the top edge having a top edge length and the bottom edge having a bottom edge length, the top edge length being less than the bottom edge length. The vertical support of the first support member is immediately adjacent the vertical support of the second support member.

9 Claims, 18 Drawing Sheets

10
A°
45
15
30
35
20
25
40
50
60
65
70
75
80
85

PACKAGE ASSEMBLY

CROSS-REFERENCE TO RELATED APPLICATIONS

This application is a continuation-in-part (CIP) of U.S. patent application Ser. No. 10/668,646 filed Sep. 23, 2003, now U.S. Pat. No. 7,730,361, which is a CIP of U.S. patent application Ser. No. 10/388,100, filed Mar. 13, 2003, now abandoned, which is a continuation of U.S. patent application Ser. No. 09/902,971, filed Jul. 11, 2001 and issued as U.S. Pat. No. 6,588,594, the entire contents of each is expressly incorporated herein by reference.

STATEMENT REGARDING FEDERALLY SPONSORED RESEARCH

Not Applicable

BACKGROUND OF THE INVENTION

1. Field of the Invention

This invention relates generally to package assemblies and in particular to a package assembly suitable for shipping as well as product display, which features open portions in its front and rear.

2. Description of the Related Art

Devices for packing and shipping products and/or containers of products are known. Such devices are available in a wide variety of shapes, sizes and styles. Often a package assembly is designed to contain a number of different containers, such as several containers of a product, in a single package assembly for delivery from one location to another, such as from a manufacturer to a wholesaler or retail seller. Sometimes the shipping package assembly is also used to display the product once the assembly is opened at the retail seller.

In many cases, the package assembly used to ship containers of product from the manufacturer to the retailer is of such type that the containers need to be removed from the assembly prior to displaying the containers in the retail environment. Removing the containers from the package assembly is often time and labor intensive. Therefore package assemblies are often used that are suitable both for shipping as wells as retail display.

There has been a trend toward decreasing the size of the display package assembly, due in part to the expense of shelf space in the retail environment. The need for smaller display assemblies is growing as more and more products compete for limited shelf space.

The trend toward smaller display package assemblies is also driven by the need to reduce production costs, reduce waste, and reduce our consumption of natural resources. In our global economy, reducing production costs is critical for maintaining competitiveness. Any design change that results in savings is critical. And, retailers are concerned with reducing waste after they receive shipments—there is a large cost associated with managing and disposing of waste after the containers have been removed from the package assemblies. Finally, creating or even recycling paper board and corrugated fiberboard, two staples in creating package assemblies, along with a number of other materials used in creating package assemblies, consume enormous amounts of natural resources. Whether it is the clear-cutting of forests, use of massive amounts of water, or consumption of large amounts of fuel in their production, there is no doubt package assemblies have a large environmental impact.

As such, there is a need for a cost effective low-bulk package assembly that is capable of shipping a plurality of containers and then transitioning to retail display.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

BRIEF SUMMARY OF THE INVENTION

At least some embodiments of the present invention are directed to package assemblies that provide a material savings of approximately 15% to approximately 30% per assembly when compared to known package assemblies used for shipping equivalent products. For example, in at least one embodiment, the inventive package assembly has been determined to utilize approximately 23% less corrugate (by surface area) than a Bliss style box, about 19% less than an RSC case, and about 11% less than a 'short-flap' RSC case. The reduction in packaging material reduces production costs and conserves material. At the same time however, such a package assembly provides equivalent, if not greater, structural strength, particularly stacking strength (vertical), as that exhibited by the more material intensive known package assemblies mentioned above.

In at least one embodiment, the invention is directed to a container package assembly which includes a first support member and a second support member. Both the first support member and the second support member have a top, a bottom, a first side, a second side, and a vertical support. For each support member, the vertical support is integrally engaged to the top, the bottom, the first side, and the second side. For each support member, the top is substantially parallel to the bottom, the first side is substantially parallel to the second side, and the vertical support is substantially perpendicular to the top and the bottom. For each support member, the first side and the second side have a top edge and a bottom edge, the top edge having a top edge length and the bottom edge having a bottom edge length, the top edge length being less than the bottom edge length. The vertical support of the first support member is immediately adjacent the vertical support of the second support member.

In some embodiments, one or both of the first support member and the second support member further include a transition region between the top and the first side and/or the second side. The transition region extends at an oblique angle relative to the first side and/or the second side. Oblique is defined herein to mean "neither perpendicular nor parallel to a given line or surface; slanting; sloping." (www.dictionary.com)

In at least one embodiment, the assembly further includes a plurality of containers positioned on the bottom of the first support member and the second support member.

In some embodiments, the assembly further includes a film, wherein the assembly is at least partially encapsulated by the film.

In at least one embodiment, the assembly further includes a top pad. A first portion of the top pad is engaged to a portion of the top of the first support member and a second portion of the top pad is engaged to a portion of the top of the second support member.

In some embodiments, the vertical support of the first support member is adhesively engaged to the vertical support of the second support member.

In at least one embodiment, the assembly has a substantially trapezoidal shape in side view.

In some embodiments, each of the first support member and the second support member has a substantially trapezoidal shape in side view.

In at least one embodiment, each of the first support member and the second support member are formed from a respective unitary, folded cardboard blank.

In some embodiments, the assembly defines at least one handgrip.

In at least one embodiment, the handgrip is at least partially defined by one or both of the first side and the second side.

In some embodiments, the handgrip is at least partially defined by the vertical support.

In at least one embodiment, the invention is directed to a container package assembly which includes a first support member and a second support member. The first support member and the second support member each have a bottom, a first side, a second side, and a vertical support. The vertical support is integrally engaged to the bottom, the first side, and the second side. For each support member, the first side is substantially parallel to the second side, and the vertical support is substantially perpendicular to the bottom. For each support member, each of the first side and the second side have a top edge and a bottom edge, the top edge having a top edge length and the bottom edge having a bottom edge length, the top edge length being less than the bottom edge length. The vertical support of the first support member is immediately adjacent the vertical support member of the second support member.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
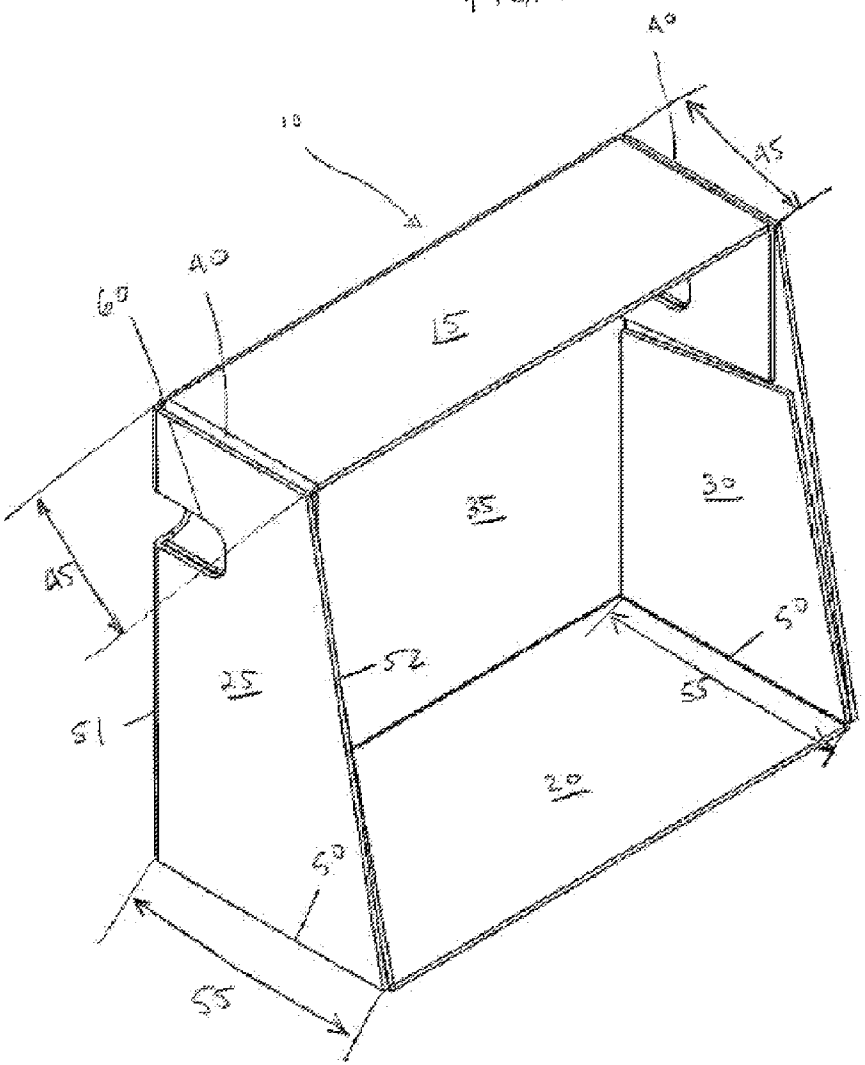
FIG. 1 is a perspective view illustrating an exemplary support member in accordance with one embodiment of the present invention.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 5:
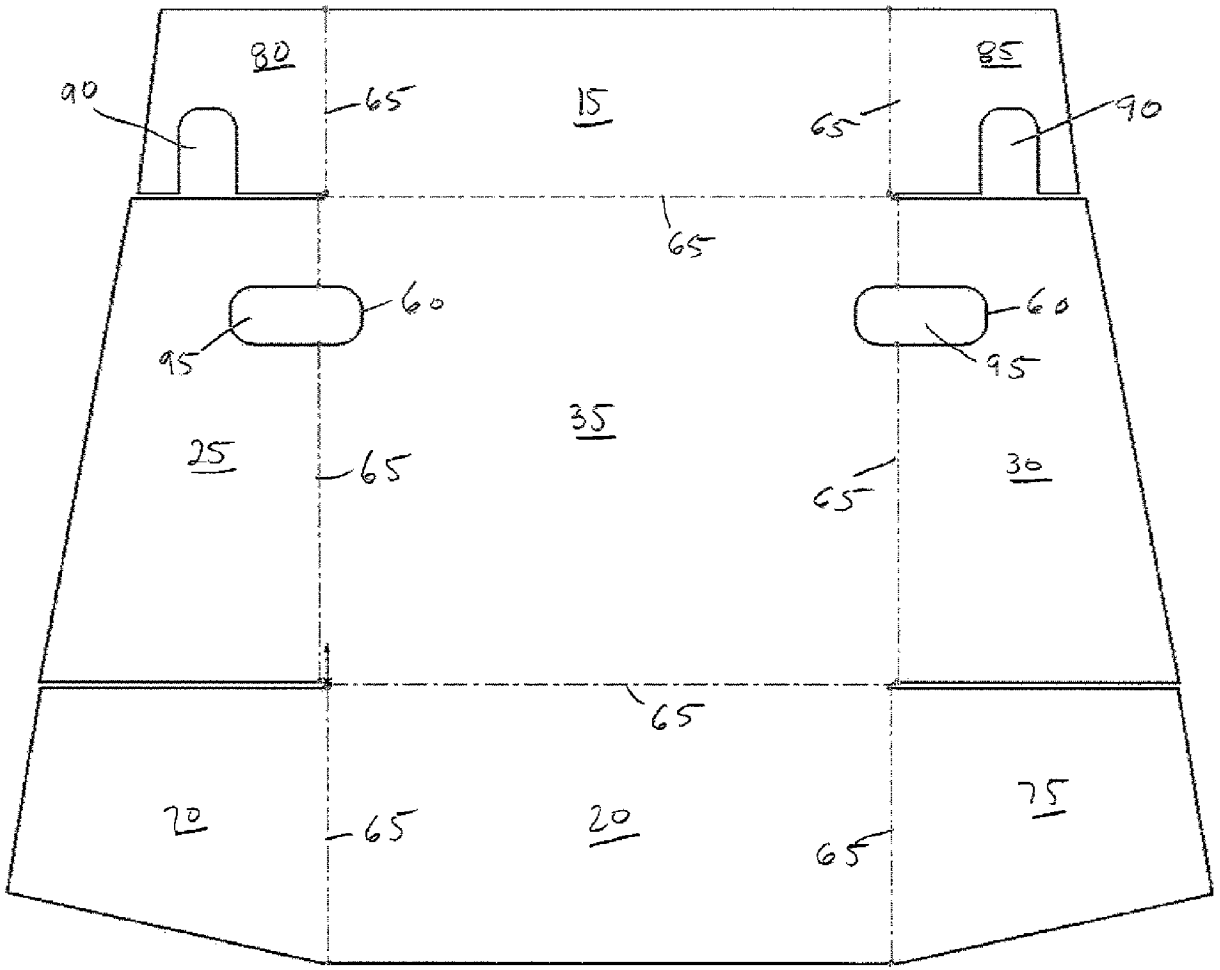
FIG. 5 is a plan view illustrating a typical blank construction for making the support member shown in FIG. 1, in accordance with one embodiment of the present invention.

Referring first to FIG. 1, the support member shown generally at 10 includes a top 15, a bottom 20, a pair of sides (25, 30), and a vertical support 35. As best seen in FIG. 5, the top 15, the bottom 20, and the sides (25, 30) are all foldably and integrally engaged to the vertical support. The support member 10 may be constructed from any material suitable for shipping and displaying containers. Such materials may include paperboard, corrugated fiberboard, press-board, chipboard, SBS board, wood, one or more paper product derivatives, plastic, metal or other materials. Preferably, the support members are constructed from a light weight material that may be easily and inexpensively recycled or disposed of.

The support member 10 is constructed so that the top 15 and bottom 20 are substantially parallel with one another. Likewise, the sides (25, 30) are substantially parallel with one another. To provide superior strength, the vertical support 35 is integrally engaged such that it is substantially perpendicular to the top and bottom as well as the sides.

Still referring to FIG. 1, both of the sides (25, 30) have a top edge 40 having a length 45, and a bottom edge 50 having a length 55. In a preferred embodiment, as seen in FIG. 1, the length 45 of the top edge of the support member 10 is less than the length 55 of the bottom edge. A trapezoid is a quadrilateral plane figure having two parallel and two nonparallel sides. (www.dictionary.com). The top edge 40 and the bottom edge 50 are substantially parallel, and because the length 45 and the length 55 are not equal, the edges 51 and 52 are nonparallel. As such, in side view the support member has a substantially trapezoidal shape.

Figure 2:
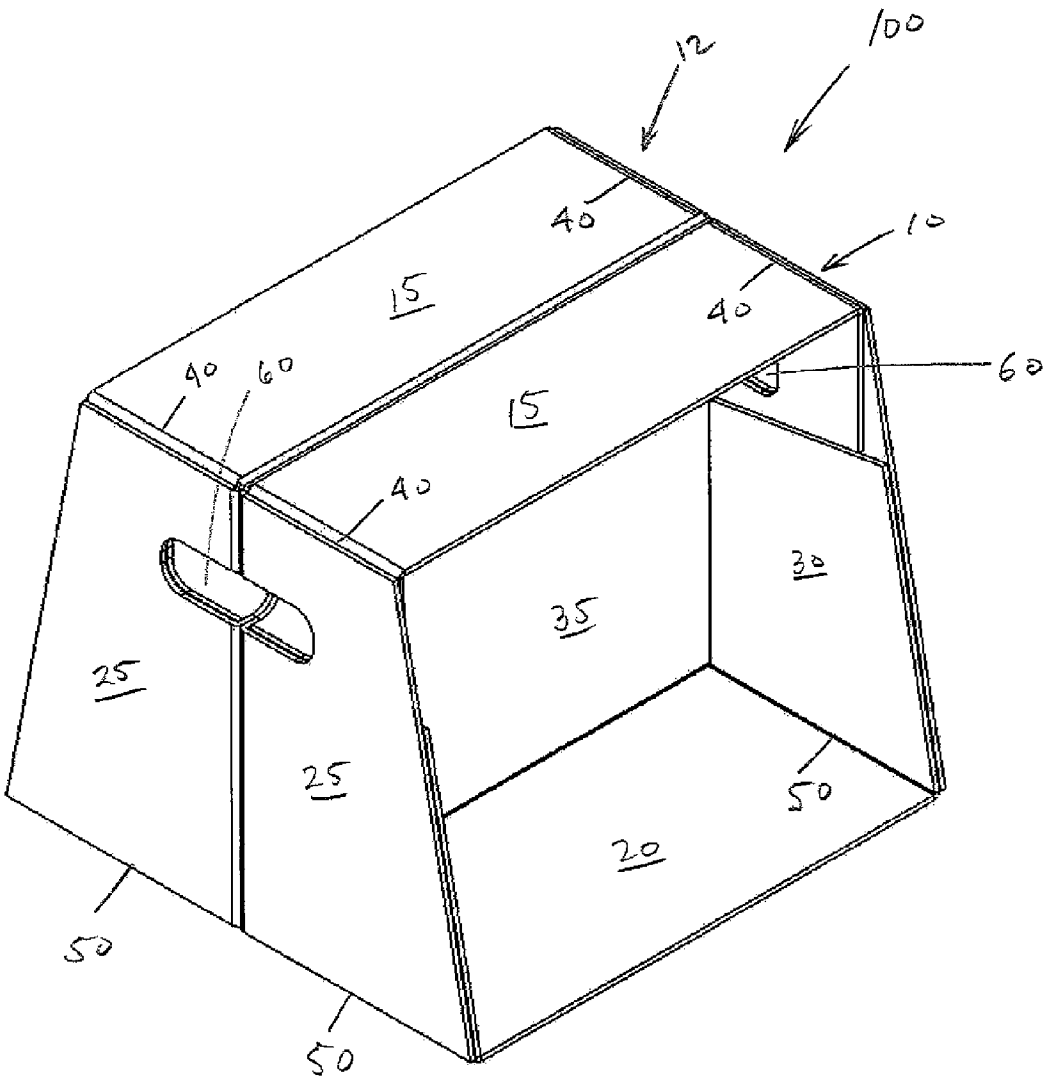
FIG. 2 is a perspective view illustrating an exemplary assembly of two of the support members shown in FIG. 1, in accordance with one embodiment of the present invention.

FIG. 2 depicts a preferred embodiment of the assembly, shown generally at 100. In FIG. 2, two support members (10, 12) immediately adjacent one another, form a container package assembly 100. As seen in FIG. 2, the two support members are in opposition such that the vertical support 35 of one support member 10 is immediately adjacent the vertical support 35 (not shown) of the other support member 12. Orienting the support members in such a manner provides a number of structural benefits to the assembly. By orienting the two support members such that the two vertical supports are abutting, vertical support is concentrated at the center of the assembly, thereby increasing the compression strength, and thus the stacking capability, of an assembly. Furthermore, because the bottom edges 50 of each support member is longer than the top edges of each support member, such an orientation provides the assembly with excellent stability both alone and, most importantly, when assemblies are stacked on one another.

The two immediately adjacent vertical supports 35 shown in FIG. 2 may be adhesively engaged. Adhesive engagement between the vertical supports may improve the overall strength, durability, and stability of the assembly 100. The vertical supports may be permanently or temporarily engaged to one another by any of a variety of adhesive materials, such as removable adhesives, time release adhesives, biodegradable adhesives, etc.

In at least one embodiment, the adhesive is a hot melt adhesive which may be applied by applicators. By means of appropriate adhesive dispensing equipment, the nature of which will be readily apparent to those familiar with the art, strips of adhesive may be placed on the vertical supports. For optimal results, both the application temperature and depth of an adhesive strip should be consistent.

In order to form a temporary bond, the hot melt adhesive should have an open time of approximately 30 to 45 seconds. The open time is defined as the period between application of adhesive on a vertical support and solidification of adhesive.

An example of an adhesive suitable for use with at least one embodiment of the present invention is commercially available from H. B. Fuller as Product No. H.L. 7674. Depending upon the type of handling contemplated, however, the specific open time may vary. In general, an open time of between about 5 seconds to about 1 minute is particularly well suited for the present invention.

The specific bonding strength of the adhesive is controlled by varying the application temperature of the adhesive, and the depth of the adhesive strips (generally 1/16 to 1/8" depth). A higher application temperature and deeper adhesive strips will increase the bonding, and a lower temperature and thinner adhesive strips will decrease bonding. In general, the hot melt adhesive is preferably applied within a temperature range of 270 degrees Fahrenheit to 340 degrees Fahrenheit.

More information regarding suitable adhesives may be found in U.S. Pat. No. 6,499,596, the entire content of which is hereby expressly incorporated by reference in its entirety.

Figure 4:
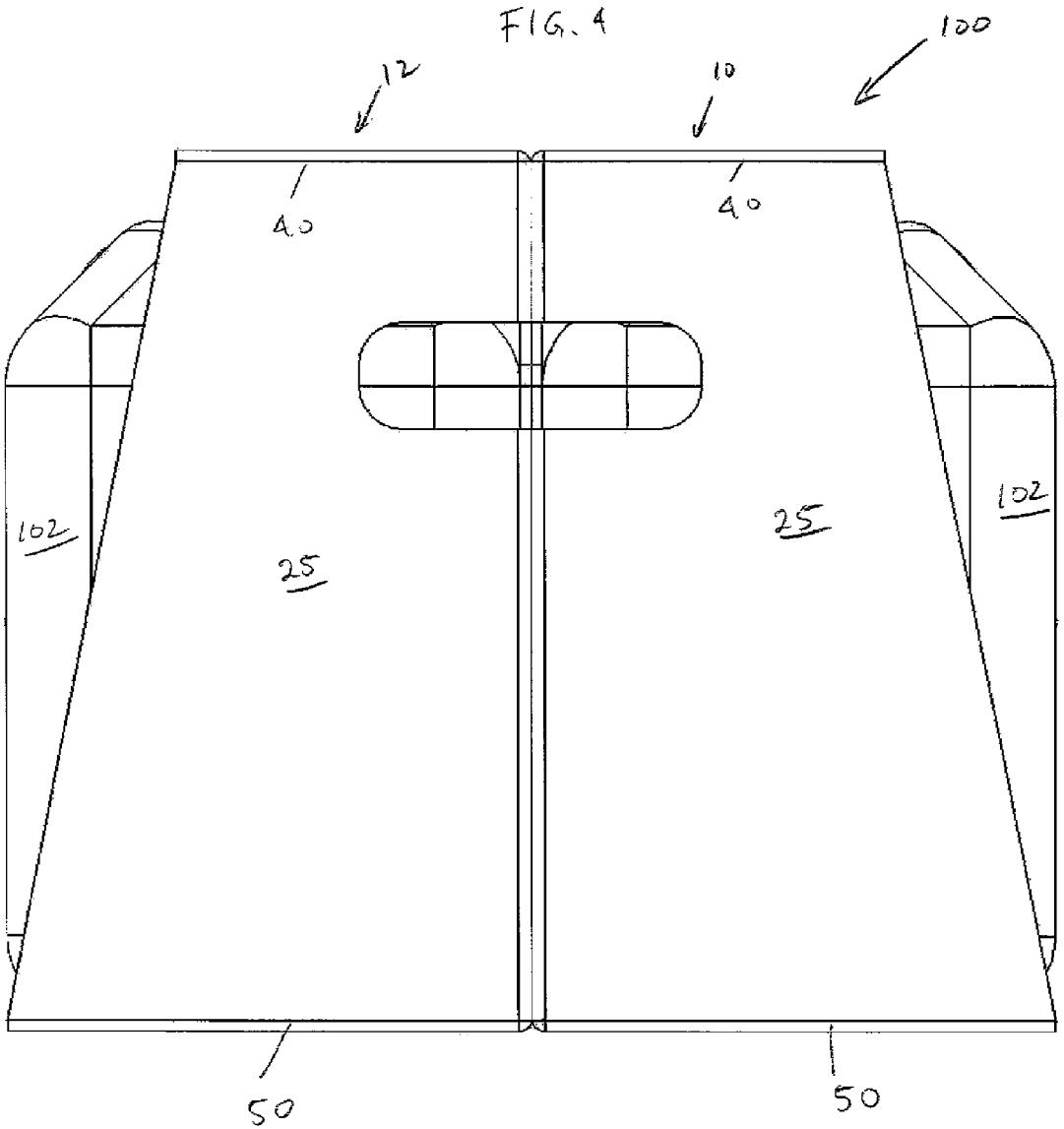
FIG. 4 is a side view of the assembly shown in FIG. 3, in accordance with one embodiment of the present invention.

As described above, each support member has a trapezoidal shape in side view. Similarly, the two support members of the assembly 100 also form a trapezoidal shape in side view, as best seen in FIG. 4. In addition to providing structural benefits, the trapezoidal shape of the inventive assembly reduces packaging material. As mentioned above, some embodiments of the inventive assembly use approximately 23% less corrugate (by surface area) than a Bliss style box, about 19% less than an RSC case, and about 11% less than a 'short-flap' RSC case. The reduction in packaging material reduces the cost of producing an assembly and also conserves material. Therefore, this reduction benefits the producer of the assembly because of reduced cost, the recipient because of a reduction in waste material that must be recycled or otherwise disposed of, and the environment.

Embodiments of the assembly may also include one or more handgrips 60, as shown in FIG. 2. The handgrip 60 may be at least partially defined by one or both sides (25, 30), as seen in FIGS. 1 and 2. As seen in the embodiment of the support member 10 shown in FIG. 1, the vertical support 35 also defines at least a portion of the handgrip 60. Providing such a cutaway in the vertical support, as best seen in FIG. 5, improves the comfort and gripping area of the handgrip 60 of the assembly 100 shown in FIG. 2.

Figure 3:
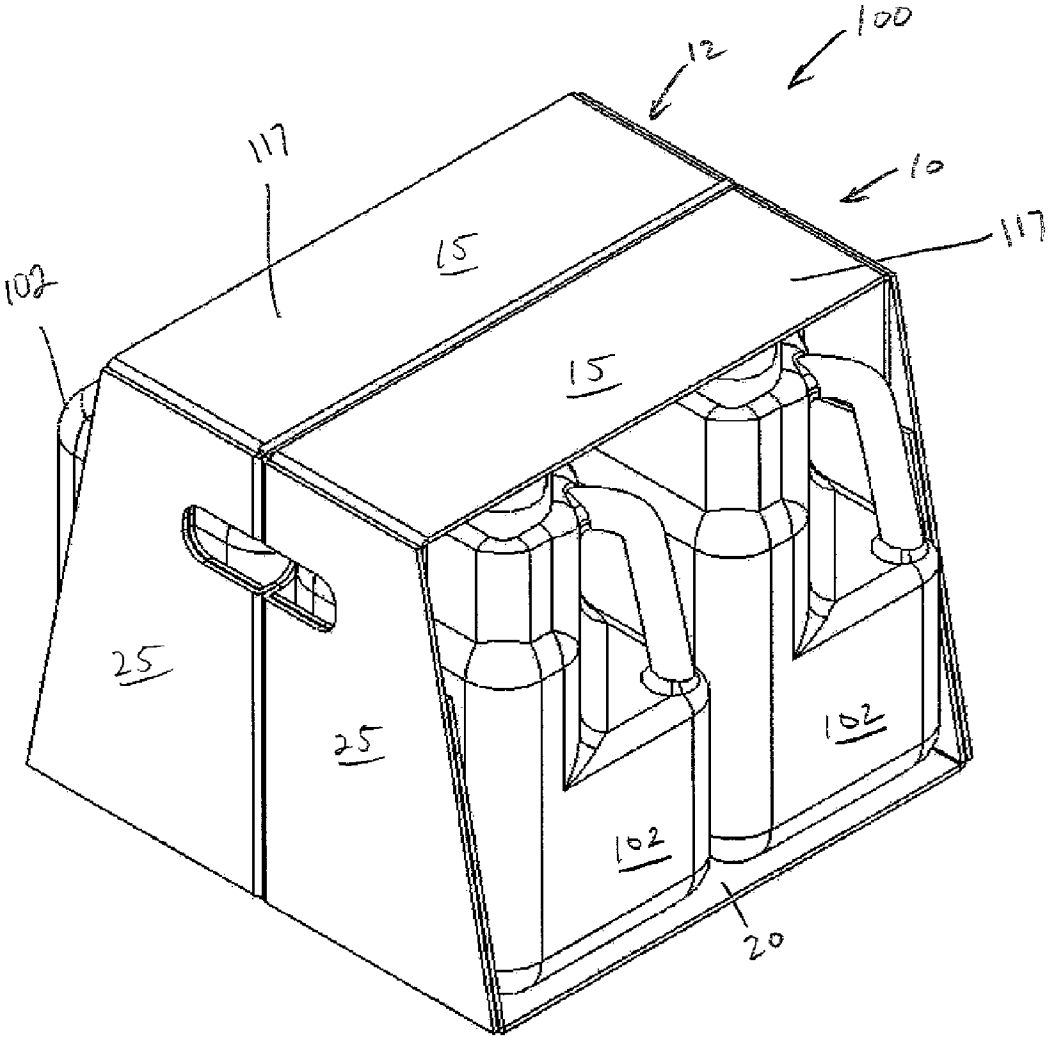
FIG. 3 is a perspective view illustrating the assembly shown in FIG. 2, along with product containers, in accordance with one embodiment of the present invention.

As mentioned above, package assemblies made in accordance with the present invention are capable of containing and displaying particularly heavy and/or bulky product containers with minimal use of material while providing excellent containment and strength characteristics. Referring now to FIG. 3, a preferred embodiment of the inventive assembly 100 is shown. The assembly of FIG. 3 is holding four containers 102, each product container 102 being an approximately 1-gallon jug of fluid. As seen, each support member (10, 12) holds two containers in place on the bottom member 20. While the preferred embodiment of the assembly holds four approximately 1-gallon jugs of fluid, other embodiments include eight ½ gallon jugs of fluid. In other embodiments, the assemblies need not hold jugs or jugs of fluid but may instead hold bottles, cans, boxes, or any other type of product container 102. In some embodiments of the assembly, depending on the number of product containers ordered by a customer, it may be desirable to have product containers in only one of the two support members (not depicted).

FIG. 5 shows a plan view of a typical unitary blank for making the support member shown in FIG. 1. FIG. 5 illustrates in detail how the vertical support 35 is integrally engaged to the top 15, the bottom 20, and the sides (25, 30) along fold lines 65. The blank comprises three substantially rectangular sections: the top 15, the bottom 20, and the vertical support 35. The blank further comprises two substantially trapezoidal sections: the two sides (25, 30). The blank further comprises four flaps (70, 75, 80, and 85). As seen in FIG. 5, the top and the bottom are foldably engaged to a first pair of opposing sides of the vertical support. The sides (25, 30) are foldably engaged to a second pair of opposing sides of the vertical support. Flaps 70, 75 are foldably engaged to opposing sides of the bottom 20 and are adjacent to the sides (25, 30), respectively. Similarly, flaps 80, 85 are foldably engaged to opposing sides of the top 15 and are adjacent sides 25, 30, respectively. Flaps 80, 85 include cutaway areas 90 that, when the blank is folded, combine with the cutaway areas 95 of the sides and vertical support to create the handgrips.

Figure 6:
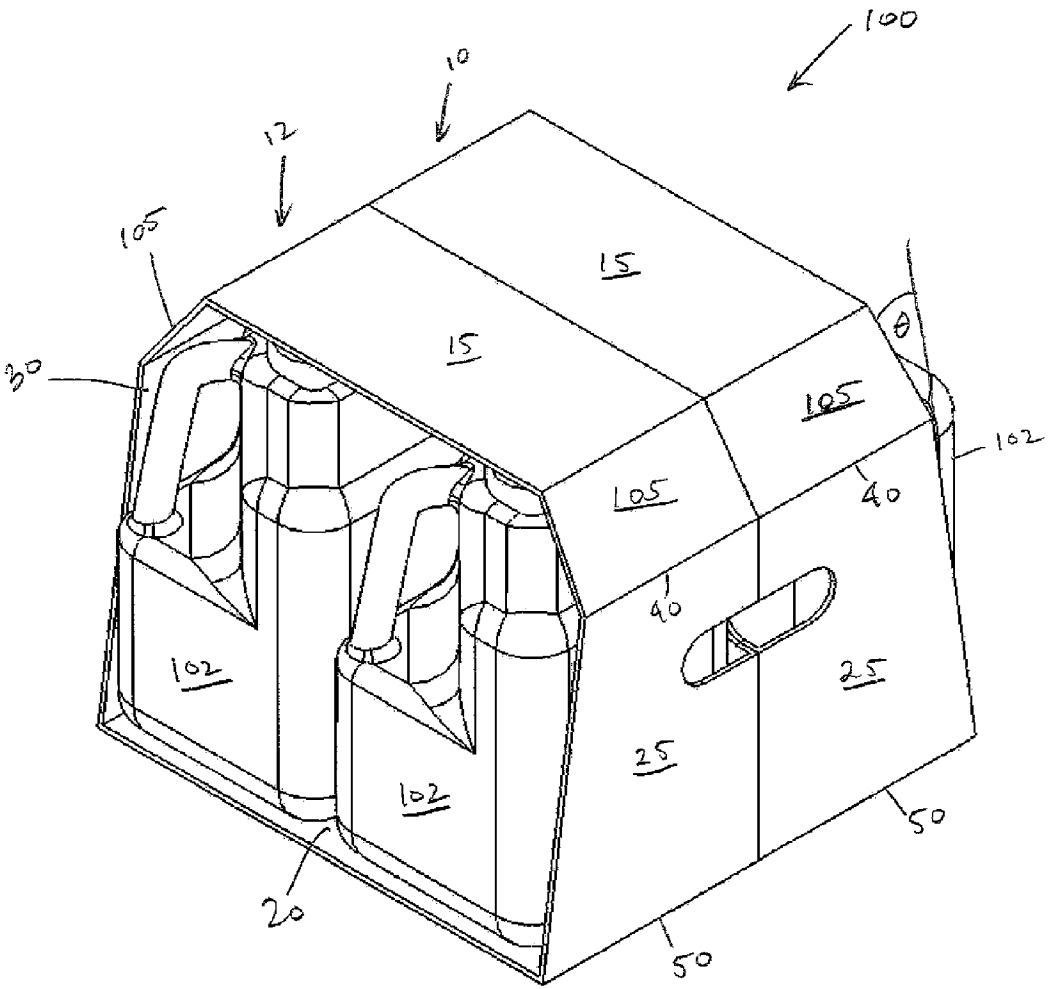
FIG. 6 is a perspective view illustrating an exemplary assembly with product containers, the assembly including transition regions, in accordance with one embodiment of the present invention.

Referring now to FIG. 6, another embodiment of the inventive assembly is shown. The assembly 100 shown in FIG. 6 is similar to the assembly in FIG. 3. However, as seen in FIG. 6, each support member (10, 12) of the assembly 100 further includes one or more transition regions 105. A transition region 105 extends between the top and a side of a support member. In some embodiments, like in FIG. 6, each support member (10, 12) include two transition regions. As depicted in FIG. 6, the transition region 105 may extend at an oblique angle θ relative to the sides. One major benefit of using assemblies with transition regions is the reduction in the overall profile of the assembly. This increases the number of assemblies that may be shipped together, and the number of assemblies that may be placed near one another on store shelves. Another benefit is the reduction in packaging material, because the assembly more closely conforms to the profile of the product containers it holds.

The sides 25 (and 30, not shown) of the support members (10, 12) have a trapezoidal shape in side view, like in the embodiments described above. The trapezoidal shape is created, as before, by providing a top edge 40 that is shorter than a bottom edge 50. In the embodiment shown in FIG. 6, the bottom edge 50 extends such that the bottom of the containers 102 are substantially fully support by the bottom 20 of the support member.

Figure 7:
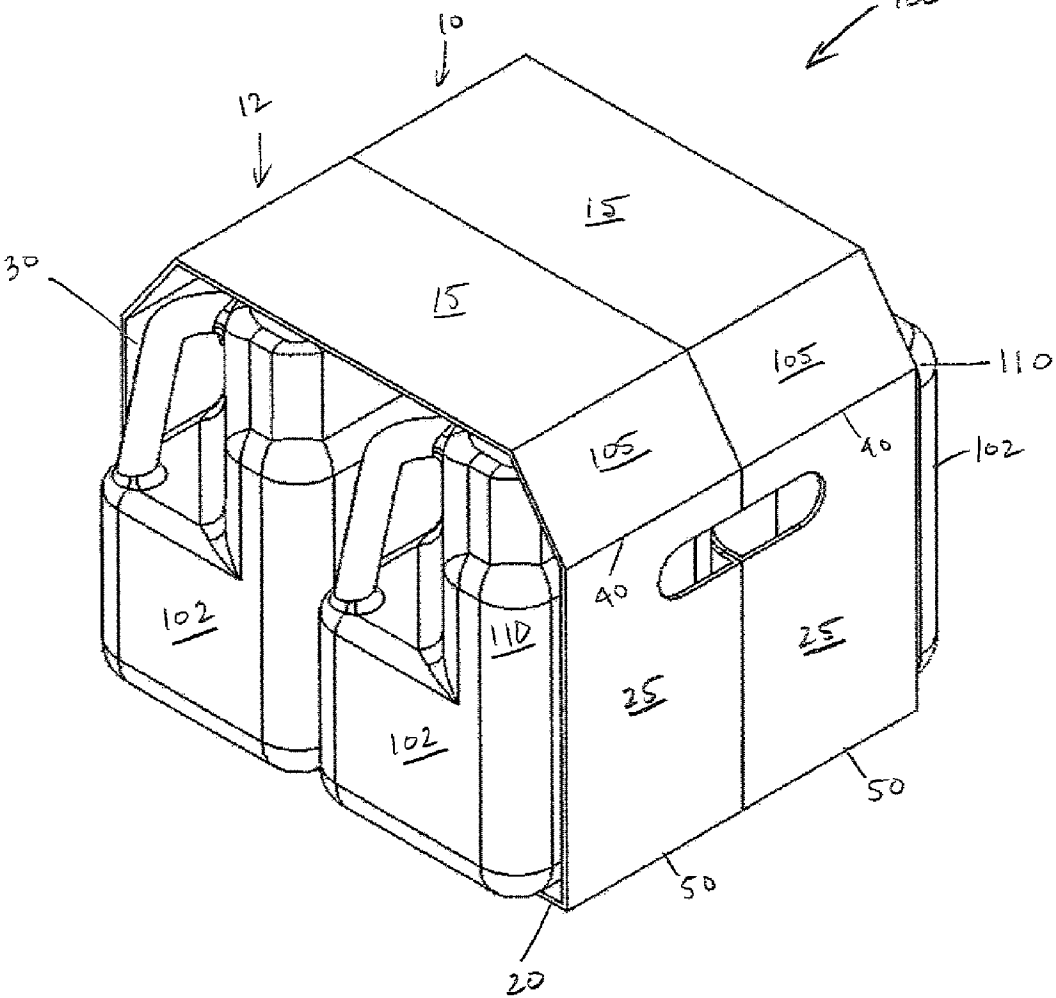
FIG. 7 is a perspective view illustrating an exemplary assembly with product containers, the assembly including transition regions, in accordance with one embodiment of the present invention.
Figure 8:
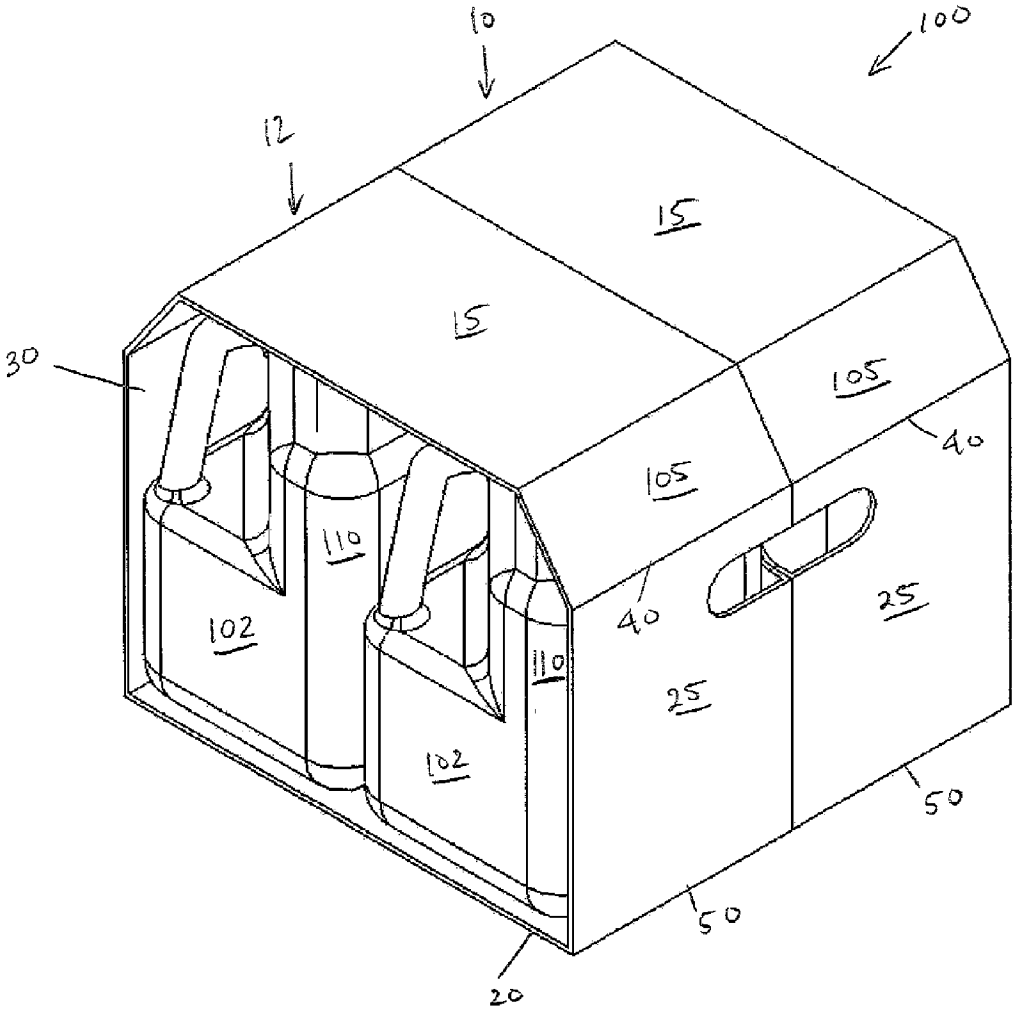
FIG. 8 is a perspective view illustrating two support members with transition regions, along with product containers, in accordance with one embodiment of the present invention.

FIGS. 7 and 8 each depict an assembly with transition regions similar to the assembly depicted in FIG. 6. However, the assemblies 100 shown in FIGS. 7 and 8 differ from the assembly shown in FIG. 6 in that the sides (25, 30) of the support members (10, 12) do not have a trapezoidal shape in side view. As seen in FIGS. 7 and 8, the sides of each support member are substantially rectangular in shape. The assembly shown in FIG. 7 depicts the assembly in FIG. 6, with the bottom edges 50 reduced in length to be substantially equal to the length of the top edges 40. Thus, a portion of the bottom of each container 102 is not supported by the bottom 20 of the support members. Such an embodiment allows for a further reduction in assembly material, while still providing the necessary support to transport and, if desired, stack the assemblies.

The assembly shown in FIG. 8 depicts the assembly in FIG. 6, with the top edges 40 increased in length to be substantially equal to the length of the bottom edges 50. Thus, like in FIG. 6, the bottom of the containers 102 is substantially fully support by the bottom 20 of the support member. And, because the top edge has been increased in length, the upper portion 110 of the containers is substantially protected by the sides (25, 30).

Figure 9:
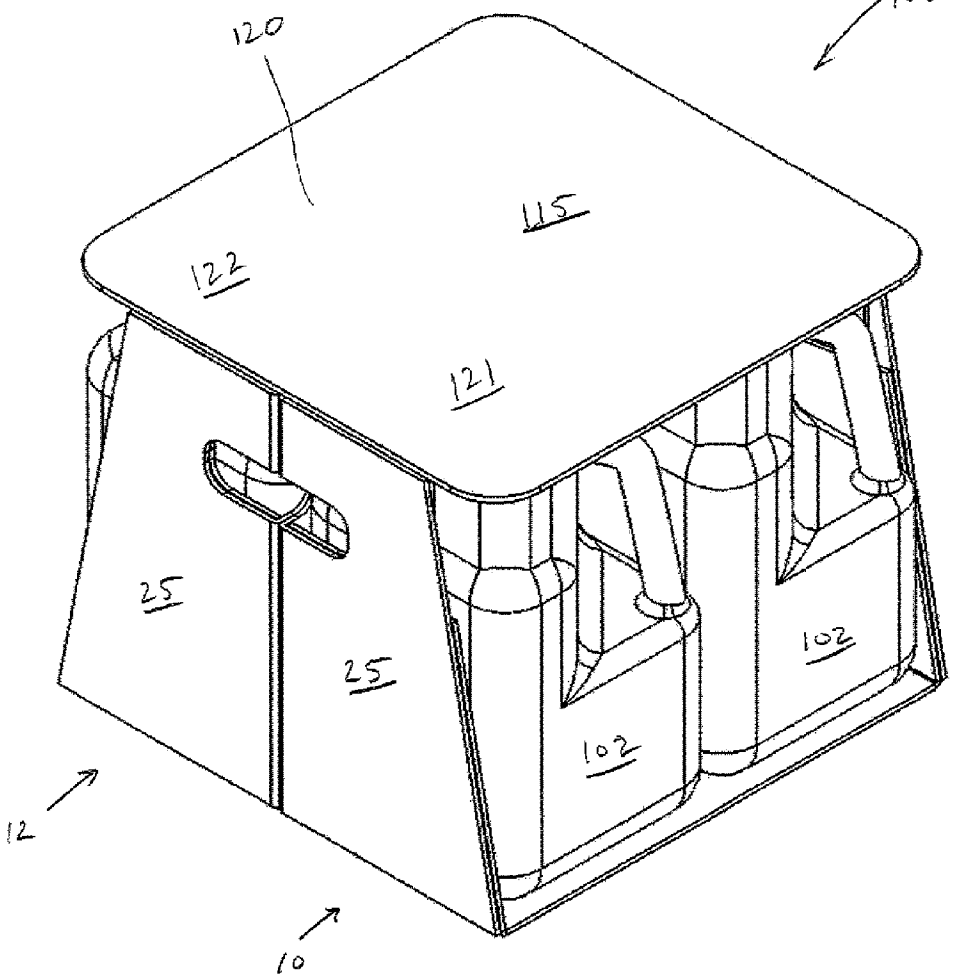
FIG. 9 is a perspective view illustrating the assembly shown in FIG. 3 and including a top pad, in accordance with one embodiment of the present invention.

Referring now to FIG. 9, the assembly of FIG. 3 is depicted with a top pad 115. Once the containers 102 are placed in the assemblies 100 in a desired arrangement, the top pad 115 is placed on top of the top 15 (as seen in FIG. 3, for example) of one or both support members (10, 12). The top pad 115 has a horizontal pad surface 120, a first portion 121 of which rests on a portion of the top support surface 117 (as seen in FIG. 3, for example) of support member 10, and a second portion 122 of which rests on a portion of the top support surface 117 of support member 12. The pad surface 120 is oriented substantially parallel to the top support surface 117. The pad surface 120 has an area which extends at least partially over each of the tops 15. The pad surface 120 of the top pad may be greater than, equal to, or less than the area of the combined tops 15 positioned thereunder. Typically, the top pad will have an area slightly less than the combined area of the tops 15 over which the top pad extends. The top pad acts as a unitizing element within the assembly to further enhance the overall strength of the assembly. The top pad 115 also forms a support between stacked assemblies.

Figure 10:
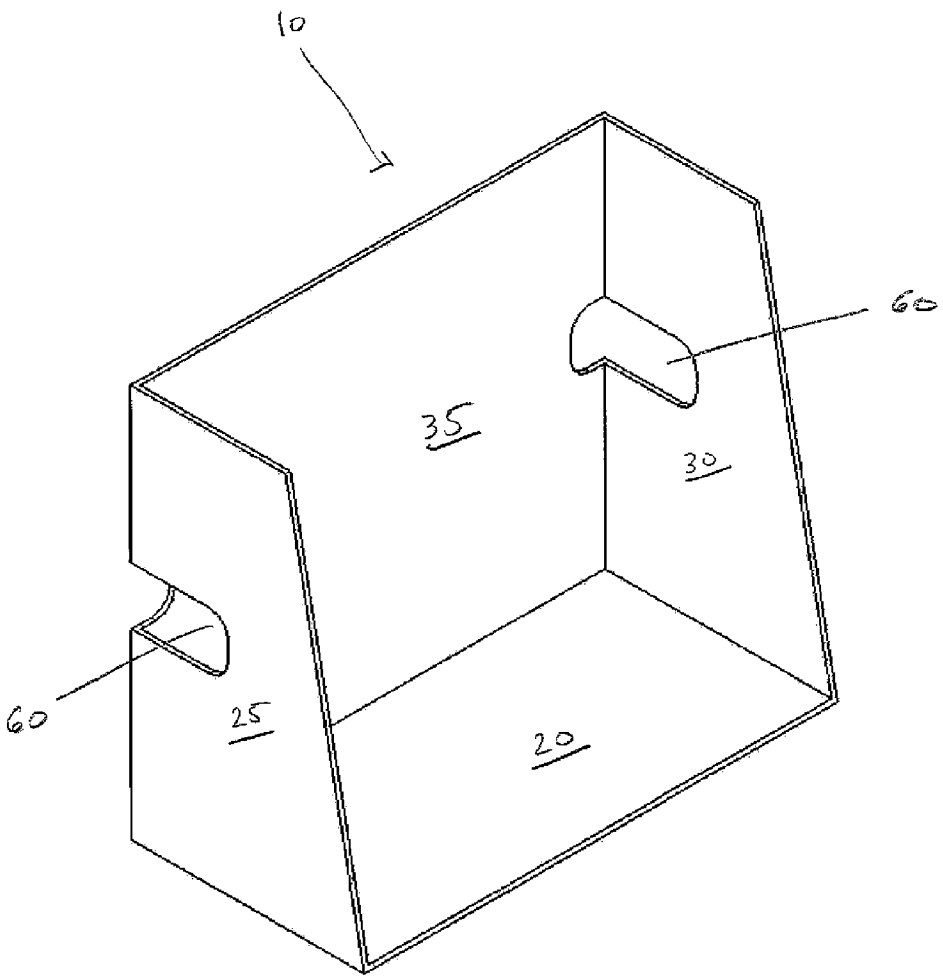
FIG. 10 is a perspective view illustrating an exemplary support member without a top, in accordance with one embodiment of the present invention.
Figure 11:
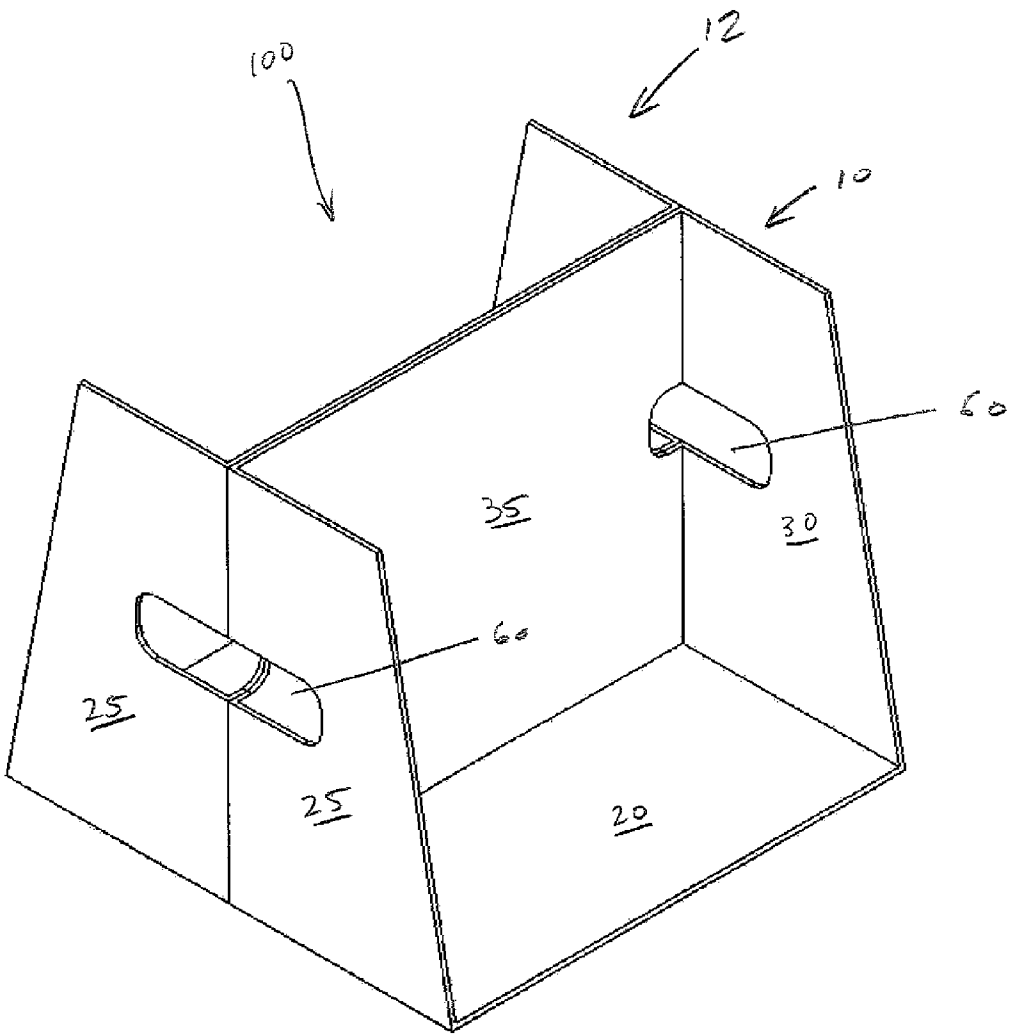
FIG. 11 is a perspective view illustrating an exemplary assembly of two of the support members shown in FIG. 10, in accordance with one embodiment of the present invention.

FIG. 10 depicts a support member 10, similar to the one shown in FIG. 11, without a top. In side view, the sides 25, 30 of FIG. 10 are trapezoidal in shape.

FIG. 1 depicts an assembly made up of two of the support members shown in FIG. 10. The assembly of FIG. 11 is similar to the assembly shown in FIG. 2, except that the support members do not have tops.

Figure 12:
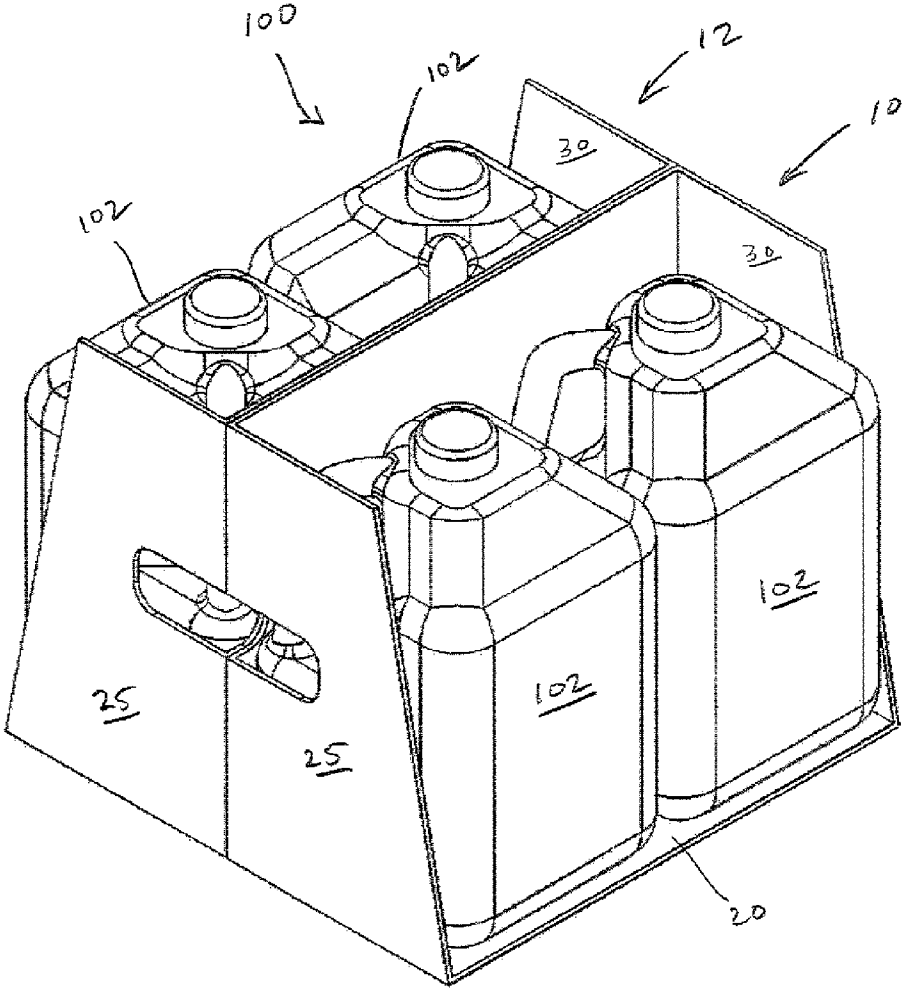
FIG. 12 is a perspective view illustrating the assembly shown in FIG. 11, along with product containers, in accordance with one embodiment of the present invention.
Figure 13:
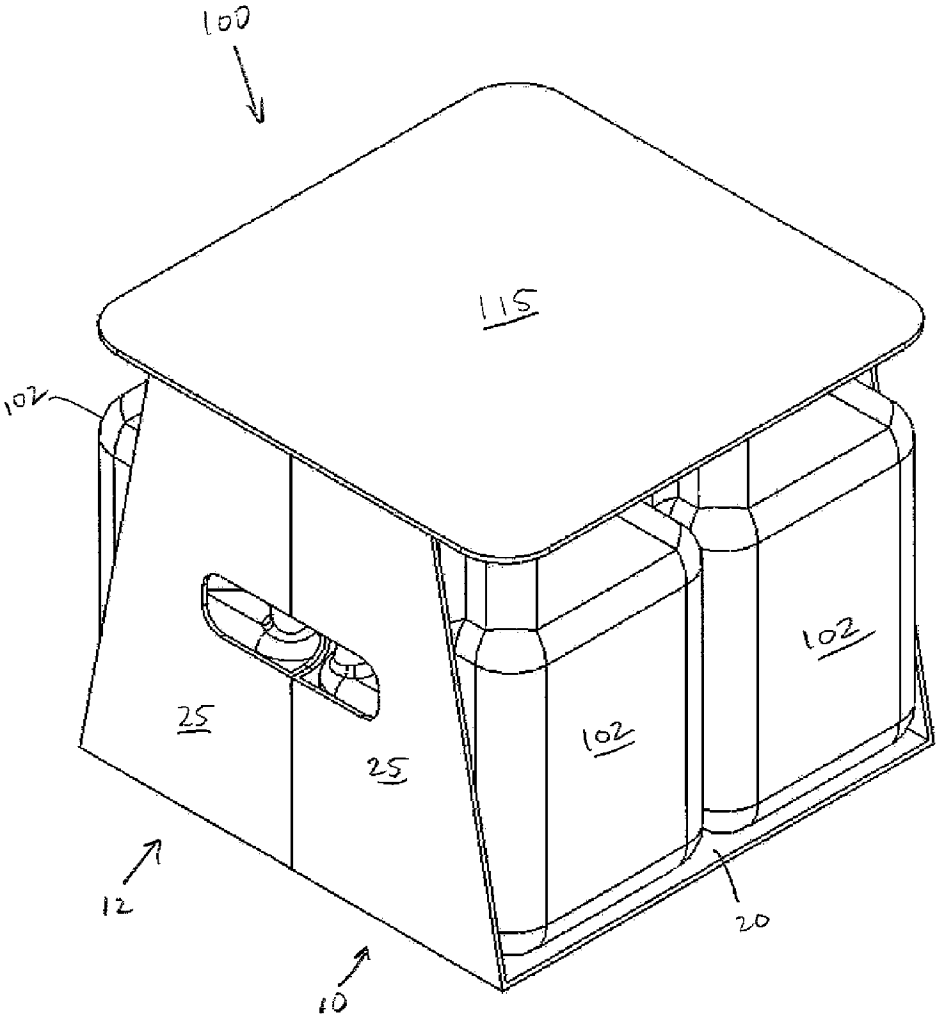
FIG. 13 is a perspective view illustrating the assembly shown in FIG. 12 and including a top pad, in accordance with one embodiment of the present invention.

FIG. 12 depicts the assembly of FIG. 1 with containers 102 placed therein. The embodiment shown in FIG. 12 provides many of the structural benefits of the assemblies with tops, but reduces packing material. Adding a top pad 115 to the assembly, such as in FIG. 13, provides additional support to the assemblies if desired for stacking the assemblies. In at least one embodiment without a top, as in FIG. 12, it may be desirable for the top pad to rest on the tops of the product containers. In such an embodiment, the height of the vertical supports and sides must be no greater than the height of the product containers to prevent distortion of the top pad and possible destabilization of stacked assemblies.

Figure 14:
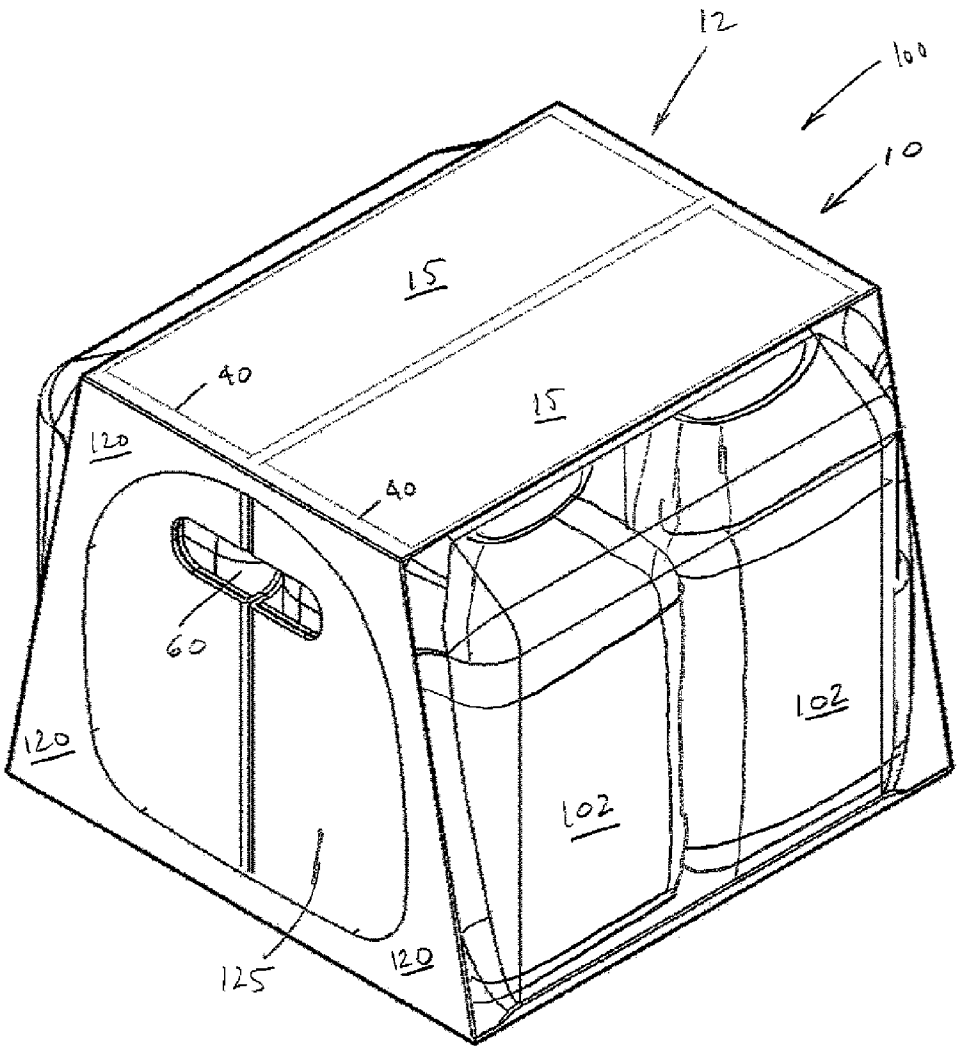
FIG. 14 is a perspective view illustrating the assembly shown in FIG. 3 encapsulated by film, in accordance with one embodiment of the present invention.

Referring now to FIG. 14, the assembly of FIG. 1 is shown partially encapsulated by a film 120. The film 120 may be any type of retaining film or material. For example the film 120 may be shrink-wrap, stretch wrap, plastic sheeting or netting, or any other type of retaining material. The film 120 may encapsulate the entire assembly, including a top pad. Alternatively, the film may have one or more openings 125 therethrough, such as is shown in FIG. 14. In at least one embodiment, the openings 125 are positioned to correspond with and provided access to the handgrips 60, such as is depicted in FIG. 14. The film 120 may be transparent, translucent or opaque. A transparent film may, however, be more preferable for retail display purposes as it is desirable to allow consumers to be able to view the containers 102 even when the film 120 is in place.

It should be noted that the embodiments of the assembly described herein not only reduce the amount of packaging material, but also reduce the amount of film used because of the reduction in overall profile. This reduction further decreases production costs and helps reduce waste and environmental impact.

Figure 15:
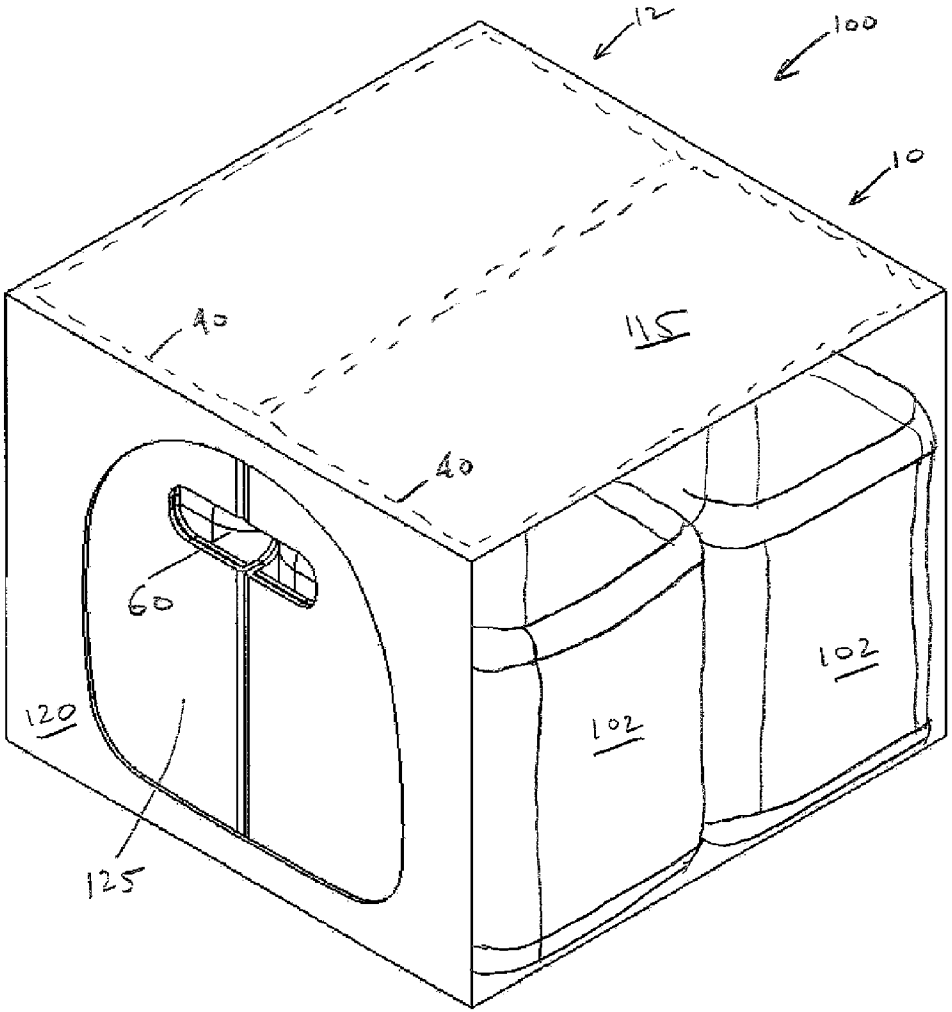
FIG. 15 is a perspective view illustrating the assembly shown in FIG. 14 and including a top pad, in accordance with one embodiment of the present invention.

FIG. 15 depicts the assembly 100 of FIG. 14 with a top pad 115. If stacking is desirable, adding a top pad 115 to the assembly provides additional support to the assemblies when stacked. The top pad 115 may further act as a cutting surface once the assembly is received. The film 120 may be cut and opened, through application of a knife or other cutting means. The presence of the top pad 115 prevents the cutting means from contacting and damaging the assemblies positioned thereunder. After the film 120 is cut and the assembly opened, the top pad 115 may then be removed from the assembly, and the assembly may be used as a shelf ready display. It should be noted that although the film is depicted herein only on embodiments without transition regions, the film may be used on all the embodiments described above and is not limited to embodiments without transition regions.

Figure 16:
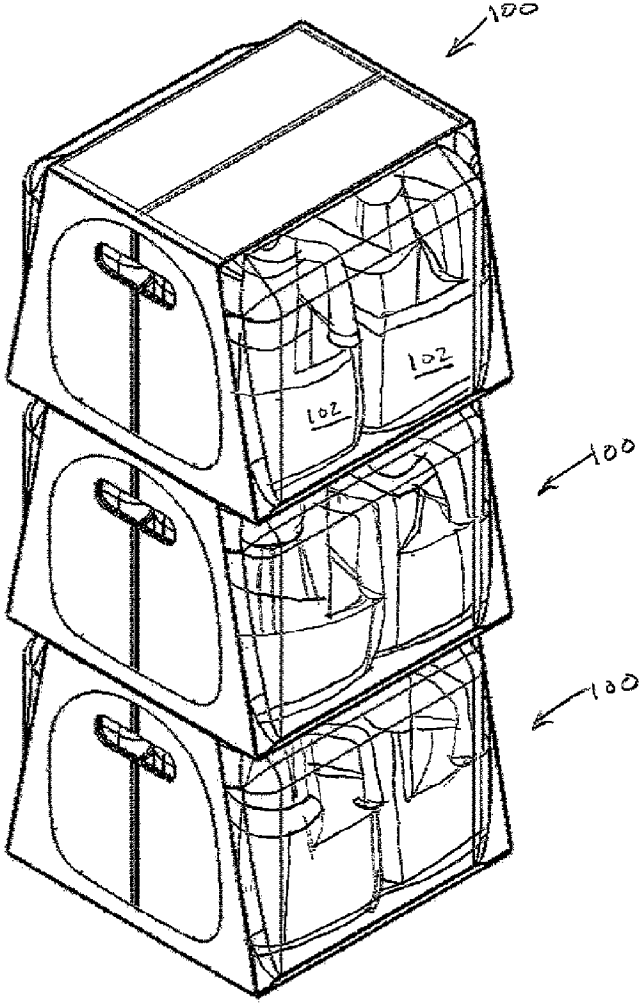
FIG. 16 is perspective view illustrating several of the assemblies shown in FIG. 15 stacked vertically.

FIG. 16 shows three of the assemblies depicted in FIG. 15 stacked vertically on top of one another. Generally, four to eight assemblies may be stacked on top of one another vertically. In at least one embodiment, five assemblies may be stacked on top of one another vertically. However, depending on the strength of the materials used, in some embodiments more than eight assemblies may be stacked on top of one another.

Figure 17:
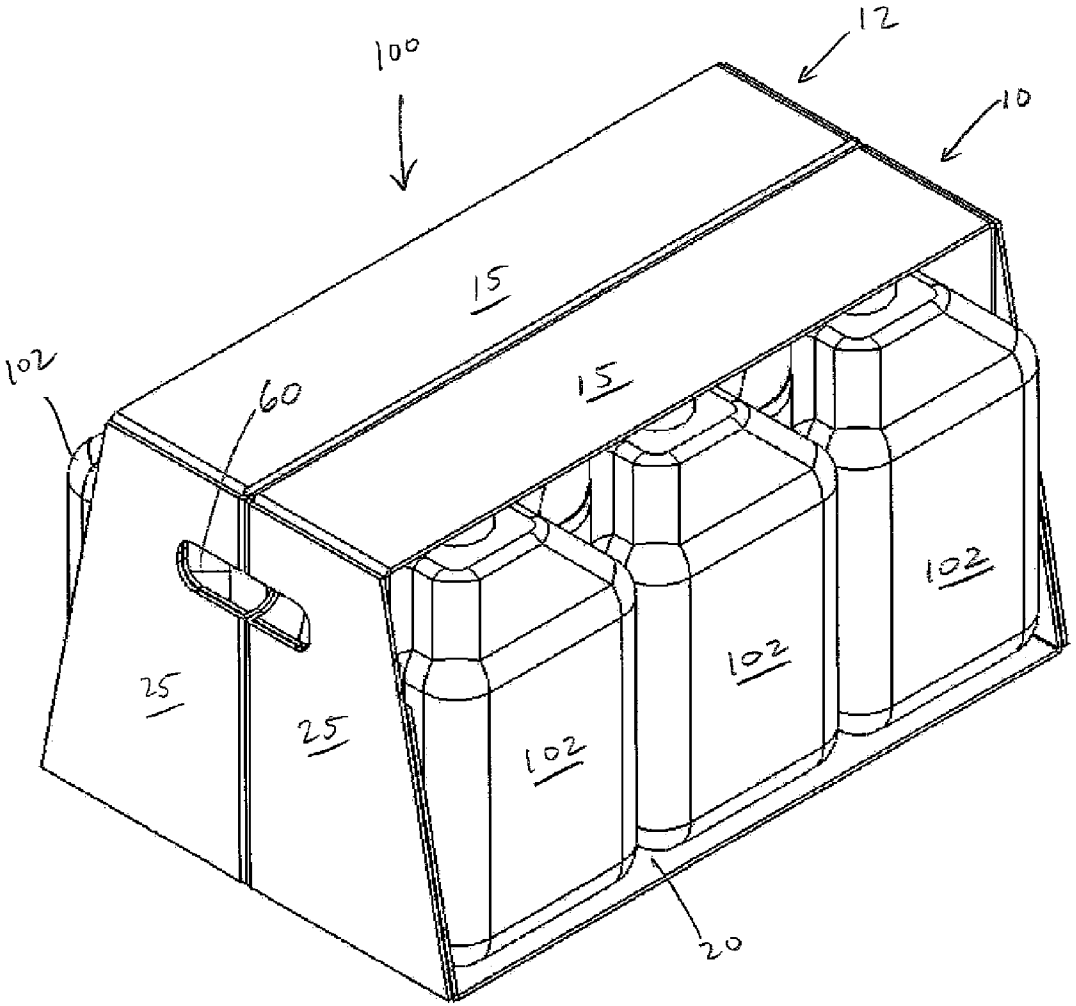
FIG. 17 is a perspective view illustrating an exemplary assembly of two of the support members shown in FIG. 1, along with six product containers, in accordance with one embodiment of the present invention.

Referring now to FIG. 17, another embodiment of the package assembly 100 is depicted. The embodiment depicted in FIG. 17 is similar to the embodiment shown in FIG. 3, but is instead capable of holding six approximately 1-gallon jugs of fluid. Of course, like all the embodiments described herein, the embodiment shown in FIG. 17 need not be limited to holding jugs of fluid, but instead may hold bottles, cans, boxes, or any other type of product container 102 that are known by those of ordinary skill in art.

Figure 18:
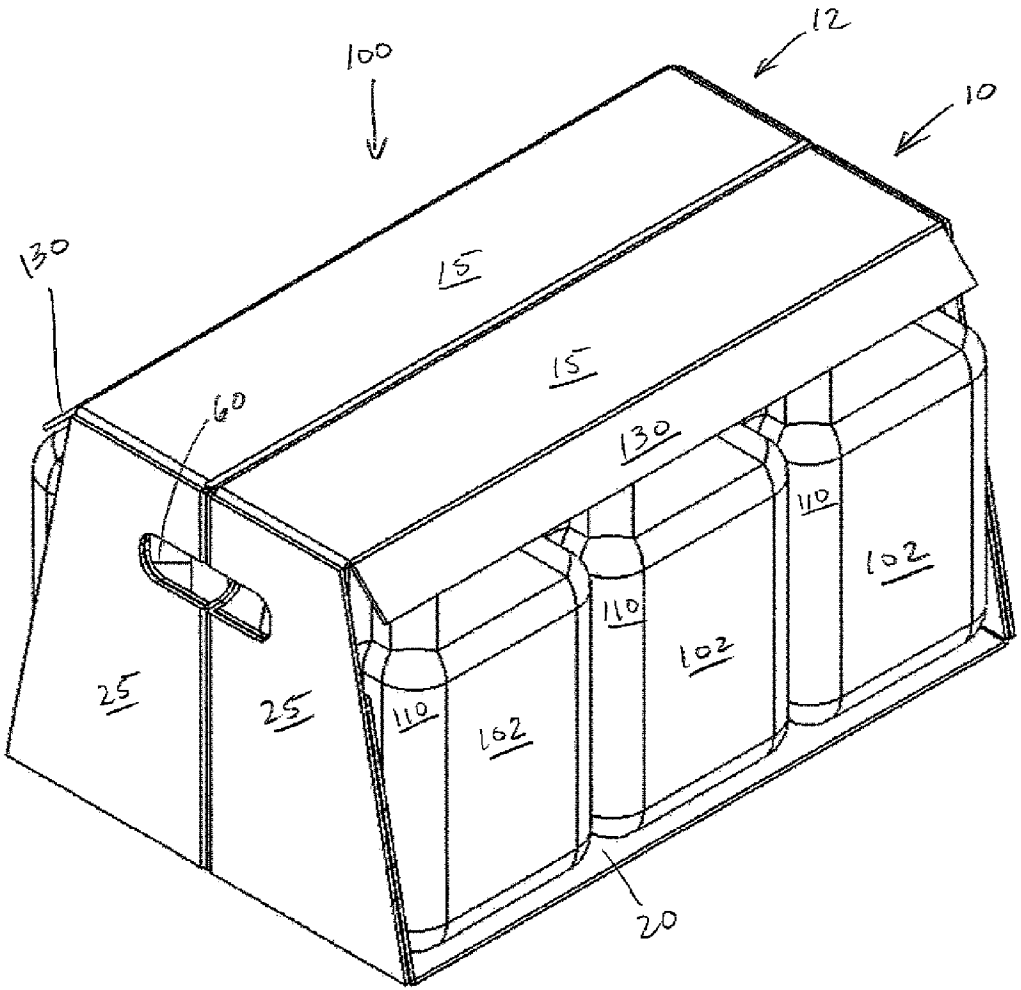
FIG. 18 is a perspective view illustrating an exemplary assembly of two of the support members shown in FIG. 17, along with protective flaps, in accordance with one embodiment of the present invention.

FIG. 18 is similar to the embodiment in FIG. 17, with the addition of protective flaps 130. The protective flaps 130 provide protection to the containers 102 by shielding the upper portion 110 for example, from the weather while the assemblies 100 are on the loading dock. The protective flaps 130 also provide a surface for placing identifying marks associated with the underlying product that is easily recognizable even at an appreciable distance.

It should be noted that embodiments without tops, such as in FIGS. 10-12 may also be designed to carry more containers, such as shown in FIG. 17 and described above. Similarly, it should be noted that embodiments with tops, such as in FIGS. 1-3, and embodiments with tops and transition regions, such as in FIGS. 6-8, may also include protective flaps like in FIG. 18.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A container package assembly comprising:

a first support member and a second support member, the first support member and the second support member each having a top, a bottom, a first side, a second side, and a vertical support, the vertical support being integrally engaged to the top, the bottom, the first side, and the second side, wherein the top is substantially parallel to the bottom, and wherein the first side is substantially parallel to the second side, and wherein the vertical support is substantially perpendicular to the top and the bottom, and wherein each of the first side and the second side having a top edge and a bottom edge, the top edge having a top edge length and the bottom edge having a bottom edge length, the top edge length being less than the bottom edge length, and wherein the vertical support of the first support member is immediately adjacent the vertical support of the second support member, and wherein at least a portion of the first side and the vertical support at least partially define a first handgrip, and at least a portion of the second side and vertical support at least partially define a second handgrip.

2. The assembly of claim 1, wherein at least one of the first support member and the second support member further comprise a transition region between the top and at least one of the first side and the second side, the transition region extending at an oblique angle relative to the first side and the second side.

3. The assembly of claim 1, further comprising a plurality of containers, the plurality of containers positioned on the bottom of the first support member and the second support member.

4. The assembly of claim 1, further comprising a film, wherein the assembly is at least partially encapsulated by the film.

5. The assembly of claim 1, further comprising a top pad, a first portion of the top pad engaged to a portion of the top of the first support member and a second portion of the top pad engaged to a portion of the top of the second support member.

6. The assembly of claim 1, wherein the vertical support of the first support member is adhesively engaged to the vertical support of the second support member.

7. The assembly of claim 1, wherein the assembly has a substantially trapezoidal shape in side view.

8. The assembly of claim 1, wherein each of the first support member and the second support member has a substantially trapezoidal shape in side view.

9. The assembly of claim 1, wherein each of the first support member and the second support member are formed from a respective unitary, folded paperboard blank.

* * * * *